United States Patent [19]

Keller et al.

[11] Patent Number: 5,048,314

[45] Date of Patent: Sep. 17, 1991

[54] APPARATUS FOR APPLYING A TREATMENT FLUID HAVING A FLOW HOMOGENIZING BAFFLE

[75] Inventors: Alfred Keller, Willich; Julius Kohnen, Tönisvorst; Wolfgang Kurschatke, Krefeld, all of Fed. Rep. of Germany

[73] Assignee: Eduard Küsters Maschinenfabrik GmbH & Co. KG, Krefeld, Fed. Rep. of Germany

[21] Appl. No.: 525,232

[22] Filed: May 16, 1990

[30] Foreign Application Priority Data

May 16, 1989 [DE] Fed. Rep. of Germany ..... 3915843

[51] Int. Cl.[5] ..... D06B 1/02

[52] U.S. Cl. ..... 68/205 R

[58] Field of Search ..... 68/200, 205 R; 118/324, 118/325

[56] References Cited

U.S. PATENT DOCUMENTS 596,905 1/1898 McCoy .
3,293,063 12/1966 Pohl et al. ..... 118/324 X
4,267,712 5/1981 Gruber ..... 68/205 R
4,375,158 3/1983 Eichmanns et al. ..... 68/205 R

FOREIGN PATENT DOCUMENTS 0019035 6/1984 European Pat. Off. .
2900702 8/1984 Fed. Rep. of Germany .
1241820 8/1971 United Kingdom ..... 68/205 R
1363724 8/1974 United Kingdom .

*Primary Examiner*—Philip R. Coe
*Attorney, Agent, or Firm*—Kenyon & Kenyon

[57] ABSTRACT

An apparatus for applying a treatment fluid on a web of material includes a run-off surface extending transversely over a web to be treated. The run-off surface slopes down obliquely onto the web and has an upper portion upon which treatment fluid applied thereto flows down over the run-off surface onto the web via the lower edge thereof. A flow homogenizing baffle is provided on the run-off surface. The baffle is formed from closely spaced deflection elements that even out any irregularities that exist in the fluid film flowing over the upper portion of the run-off surface.

4 Claims, 4 Drawing Sheets

APPARATUS FOR APPLYING A TREATMENT FLUID HAVING A FLOW HOMOGENIZING BAFFLE

BACKGROUND OF THE INVENTION

The invention relates generally to a fluid treatment apparatus for applying a treatment fluid, such as a dye, onto a web of material and, more particularly, to such fluid treatment apparatus having a flow homogenizing baffle.

Apparatus for applying a treatment fluid on an advancing web of material, in particular, a web-type textile material, via a run-off surface extending transversely over and above the web is disclosed in U.K. Patent No. 1,363,724 and European patent document 19035. These apparatus are used to create patterns on fabrics by applying various treatment fluids from the nozzles onto the run-off surface. The fluids mix on the run-off surface and, as a mixture, flow from the horizontal lower edge of the run-off surface in a veil onto the web running below the run-off surface. The main objective of the apparatus disclosed in the aforesaid documents is to produce an irregular pattern on the web of material, which generally is a textile web.

A problem with these apparatus is the attainment of sufficiently uniform distribution of the treatment fluid in the transverse direction, i.e., across the width of the web, when a uniform treatment application is essential, e.g., for the solid dyeing of a carpet. An irregular fluid distribution in the upper zone of the run-off surface may be caused by particularities of the flow prevailing there, or, as is more frequently the case, because the fluid is applied on the upper zone of the run-off surface from individual nozzles, i.e., from individual separate jets spaced from each other in transverse direction. Due to the transverse spacing of the nozzles, the treatment fluid is applied on the run-off surface at individual points, which during run-off result in thickened fluid streams that do not converge into a uniform film by the time the lower edge is reached. Thus, one of the problems to which the invention is directed is effectuating a more uniform application of treatment fluid than that achieved using an apparatus of the general type discussed above.

SUMMARY OF THE INVENTION

The invention solves this problem by providing an apparatus for applying a treatment fluid onto a web of material in which a run-off member having a top side and a bottom side is connected to a support structure of the apparatus in a position allowing a web of material to be treated in the apparatus to pass underneath the bottom side of the run-off member. The run-off member has upper and lower horizontal edges extending transverse to a web to be treated by the apparatus and defining ends of a run-off surface disposed on the top side of the run-off member. The run-off surface has an upper portion and lower portion sloping downwardly such that the lower horizontal edge is situated directly above a web to be treated by the apparatus when such as web passes underneath the run-off member. Means is provided for supplying treatment fluid to the upper portion of the run-off surface over a width corresponding to the width of a web to be treated by the apparatus. A flow homogenizing baffle is disposed on the top side of the run-off surface between the upper and lower horizontal edges and extends transversely over the width of the run-off surface. The baffle has a uniform field of deflection elements extending outwardly from the top side of the run-off surface. Each of the deflection elements has an upper transverse face proximal to the upper portion of the run-off surface and a lower transverse face proximal to the lower portion of the run-off surface. The deflection elements are arranged in at least three rows of deflection elements. The deflection elements within each of the rows are spaced from each other by a first small distance to define therebetween longitudinal channels generally perpendicular to the transverse direction, each of the longitudinal channels having an end proximal to the lower portion of the run-off surface. The rows are spaced from each other by a second small distance in the transverse direction to define therebetween transverse channels, the transverse channels being in communication with the longitudinal channels. Each row is mutually offset in the transverse direction relative to each other such that the longitudinal channels intersect the transverse channels opposite the transverse faces. The distal ends of the longitudinal channels intersect the transverse channels such that the angle therebetween is 90° or less. Treatment fluid flowing down the upper portion of the run-off surface thereby enters the baffle through the longitudinal channels in the row of deflection elements closest to the upper portion of the run-off surface and is deflected several times in the longitudinal and transverse channels, creating turbulence and reducing the velocity of the treatment fluid. The treatment fluid them exits the baffle through the longitudinal channels in the row of deflection elements closest to the lower portion of the run-off surface, and flows over the lower horizontal edge of the run-off surface in a veil uniform across the width of the run-off surface.

The apparatus of the invention evens out irregularities in the thickness of the fluid film, which are present in the upper zone of the run-off surface, as the fluid flows down over the run-off surface such that by the time the lower zone of the run-off surface is reached, a largely uniform distribution exists. The deflection of the fluid in the baffle decreases the speed of the fluid film by creation of strong turbulence and causes the fluid to build up to a dike of a certain height in front of the homogenizing baffle. The homogenizing baffle has a sufficient height, so that even at the largest dike height occurring in practice, the fluid does not flow over the top of the homogenizing baffle. Provision of a plurality of outlets from the homogenizing baffle means that per outlet a correspondingly smaller quantity of fluid, which does not form any thick streams, is present to merge with the fluid from an adjacent outlet and form a cohering film of sufficient regularity in the transverse direction of the web. Thus, the homogenizing baffle prevents the fluid from shooting down over the run-off surface at high speed, mainly in the upper zone of the run-off surface, to prevent an irregular flow distribution from there occurring.

In the wallpaper patterning apparatus disclosed in U.S. Pat. No. 596,905, a rotating roll is applied against the upper edge of the run-off surface to entrain at its surface liquid provided from a trough lying therebelow. The liquid is scraped off the roll by the upper edge of the run-off surface and then flows down over the run-off surface. The trough has adjacent compartments, spaced in transverse direction of the web, containing various colored liquids, which are to be mixed at the transitions. To this end, the upper zone of the run-off surface is provided with a field having rhomboid-shaped projections between which channels are formed. The longer diagonal of the rhomboids are arranged in the line of fall of the fluid. Although this arrangement may be useful for mixing at the edge zones of the individual colored liquids, the liquid is not deflected at a sharp angle and is not braked, so that the function of a flow homogenizing baffle does not exist.

The braking or reduction in fluid velocity, which occurs by the creation of turbulence, and the homogenization will be as effective as possible if the deflection of the fluid in the tortuous flow paths in the homogenizing baffle is at least 90° (degrees).

The homogenizing baffle may be formed from a uniform field of deflection elements formed from segments having cross-sections defined by straight lines. The elements are spaced at first small distances from each other in the transverse direction to form rows, which are spaced at second small distances from each other in the direction of the fluid fall line. The channels of each row extending parallel to the fall line are mutually offset in the transverse direction relative to the corresponding channels of the following row such that the segments form angularly disposed portions of the tortuous channels. Forming the baffle in this manner makes it relatively easy to manufacture from commercial sectional material. The deflection elements may have a square cross-section in which the angle by which the fluid is deflected is 90° (degrees) in each instance, or a "butterfly-shaped" cross-section, formed from two equal parallelograms, in which the angle of deflection is greater than 90° (degrees).

The invention is not limited to the treatment of web-type material. The term "web of material" as used herein and in the appended claims includes not only a single piece of material, but also individual pieces that may be conducted, e.g., by a conveyor belt disposed under the apparatus. The individual pieces are not required to be flat or of uniform height, but can be workpieces of different height.

Further features, advantages, and embodiments of the invention are apparent from consideration of the following detailed description, drawings and appended claims.

DETAILED DESCRIPTION

Figure 1:
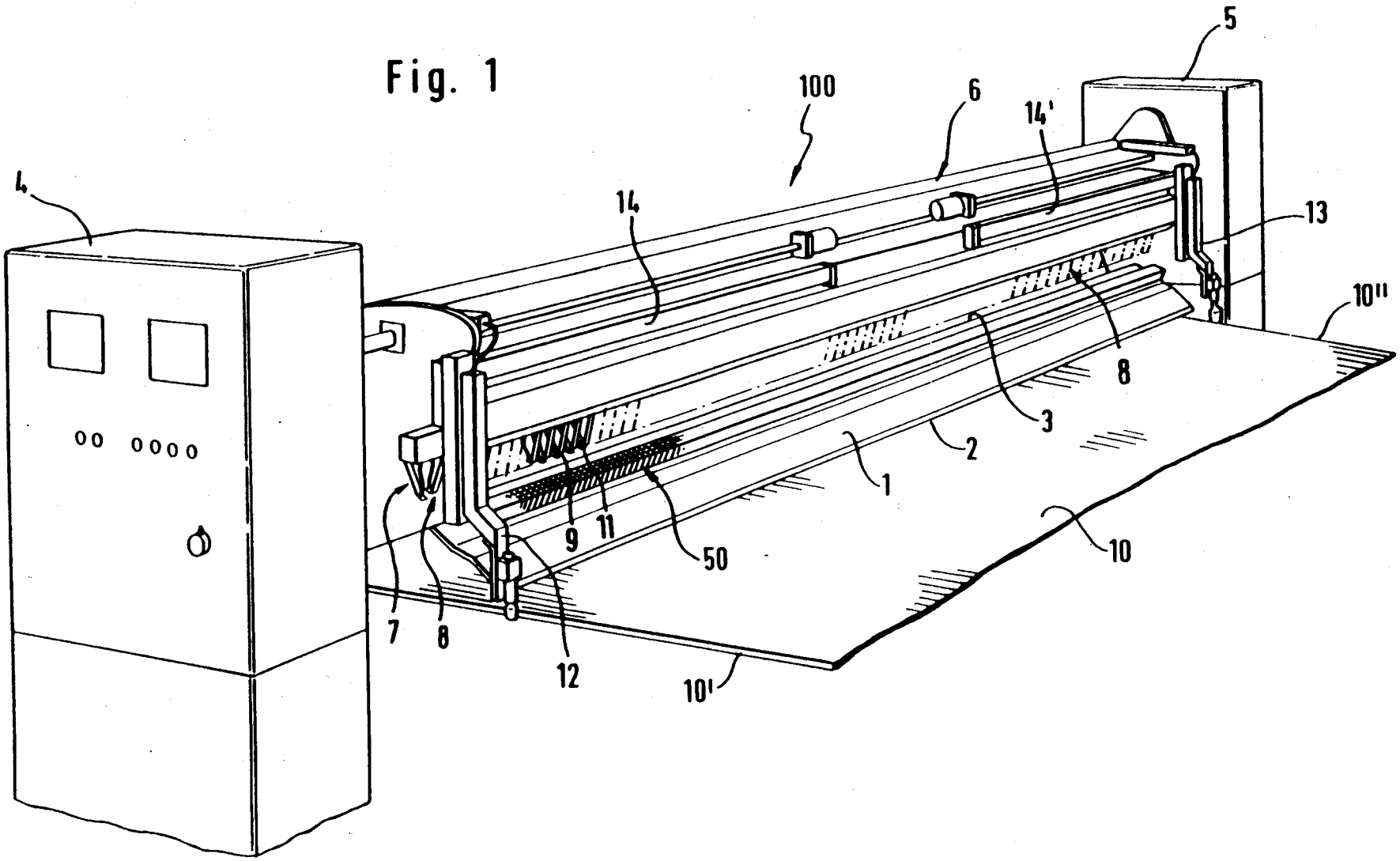
FIG. 1 is an overall perspective view of an applicator for carpet dyeing constructed according to the principles of the invention.

The applicator 100 shown in FIG. 1 is used to treat a web of material, e.g., a carpet web 10, which is conducted horizontally through the applicator, with a fluid dye constituting the treatment fluid. The apparatus 100 includes a run-off surface 1 inclined obliquely down toward the web 10 and having a lower edge 2, over which flows treatment fluid running down the run-off surface 1. The fluid flows from edge 2 in a veil uniformly over the width of the web 10 onto the web as it is conducted along directly under the edge 2. The run-off surface 1 is formed from an angularly bent, sheet metal plate, which has a substantially flat upper zone inclined at an angle of about 30° (degrees) relative to the horizontal. At the upper edge 3 of the run-off surface 1, a bent leg 1' is provided at an angle of 90° (degrees) to secure the run-off surface to the support bracket 6'.

Figure 5:
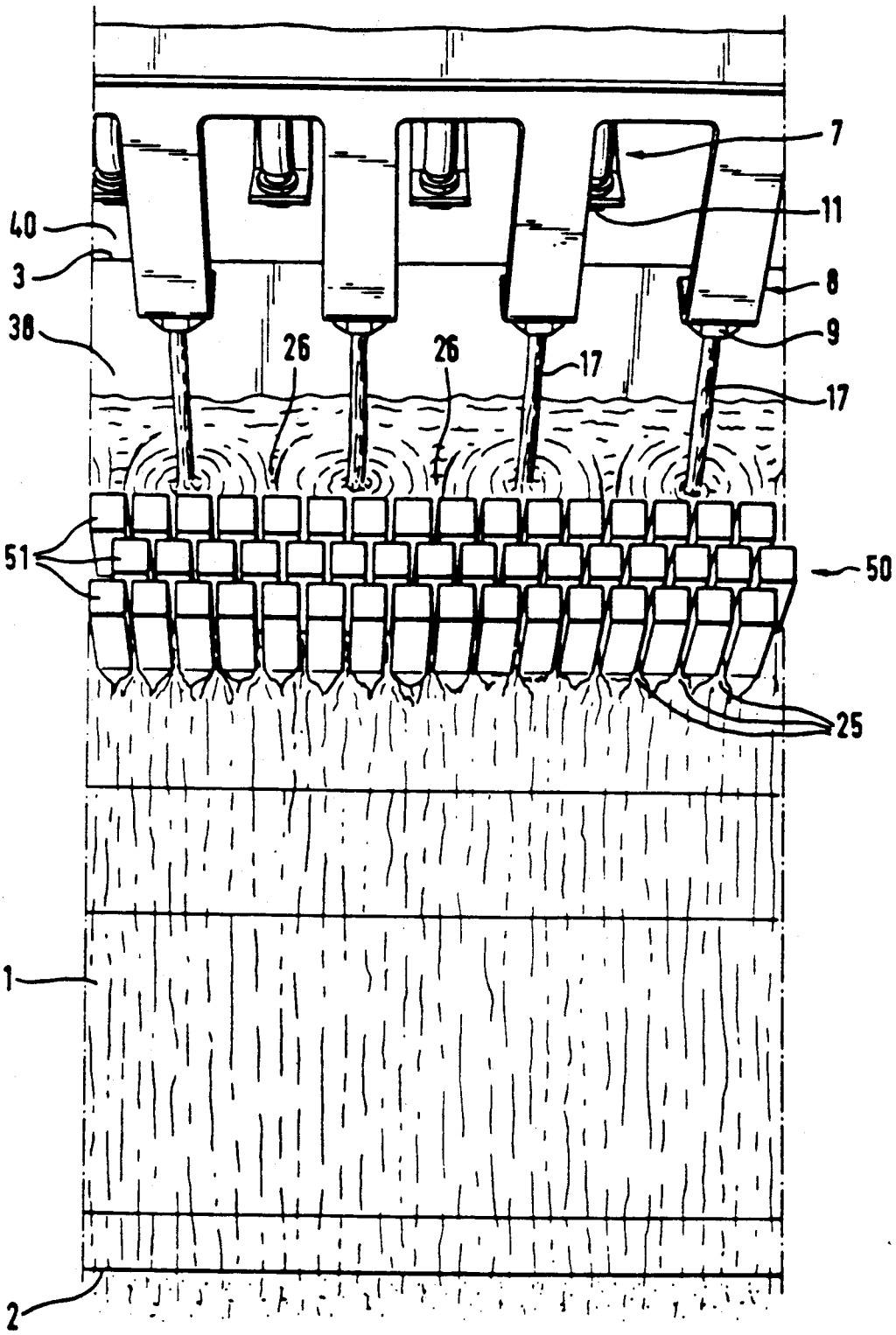
FIG. 5 is a perspective view of the apparatus taken in the region of the homogenizing baffle.

The run-off surface 1 is carried by two lateral standards 4, 5 of the applicator, which also contain the control devices for the applicator. Spaced above the run-off surface 1, a horizontal supporting structure 6, which carries the support bracket 6', extends transverse to the fabric web 10. At the underside of supporting structure 6, nozzle combs 7, 8 are pivotally mounted about an axis extending transversely above web 10. The nozzle combs and other aspects of the applicator are described in more detail in copending application Ser. No. 524,355, filed herewith and entitled Apparatus For Applying A Treatment Fluid Having Pivotal Nozzle Combs, the disclosure of which is incorporated by reference herein. At the downwardly pointing free ends of the "comb tines" of the nozzle combs 7, 8, nozzles 9, 11 (FIG. 5) are provided from which the fluid dye is directed. In one pivoted position of the nozzle combs 7, 8, the nozzles 9, 11 are disposed above the upper zone 38 of the run-off surface, so that the fluid dye flows down from the nozzles onto the upper zone 38 and runs down onto the web 10 via the lower edge 2 of the oblique run-off surface 1. In the other pivoted position of nozzle combs 7, 8, nozzles 9, 11 are located over a run-off gutter 40 disposed, according to FIG. 1, behind the upper edge 3 of the run-off surface 1. The run-off gutter collects and discharges the fluid dye flowing from the nozzles 9, 11.

The longitudinal edges 10', 10'' of web 10, which extend parallel to the running direction of the web, are scanned by edge sensors 12, 13, which are movable on tracks 14, 14' of the support structure 6 to follow the edges 10', 10''. In this manner, the nozzles 9, 11 located outside the edges 10', 10'' of web 10 may be turned off.

Figure 3:
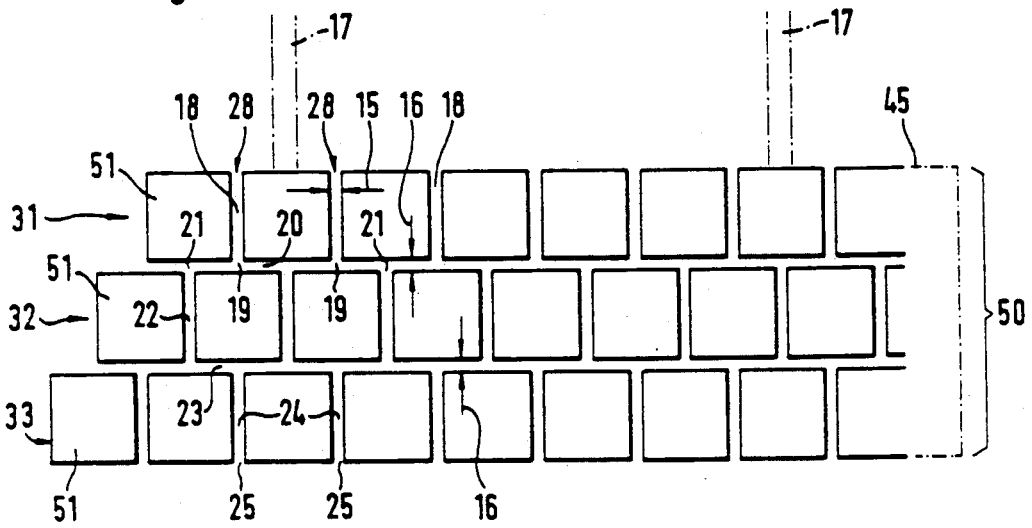
FIG. 3 is a plan view from above taken along line III—III of FIG. 2 illustrating the homogenizing baffle of the invention.

Spaced from the upper edge of the run-off surface 1, i.e., contiguous to the lower end of the upper zone 38, a flow homogenizing baffle 50 is provided. The homogenizing baffle 50 comprises a field 45 of deflection elements 51 in the form of shaped segments 52, which stand upright on, and normal to, the run-off surface 1. Segments 52 have a square cross-section, as shown in FIG. 3. The length of the sides of the squares may be about 10 mm, while the depth or height of the shaped segments 52 may be about 40 mm.

Figure 2:
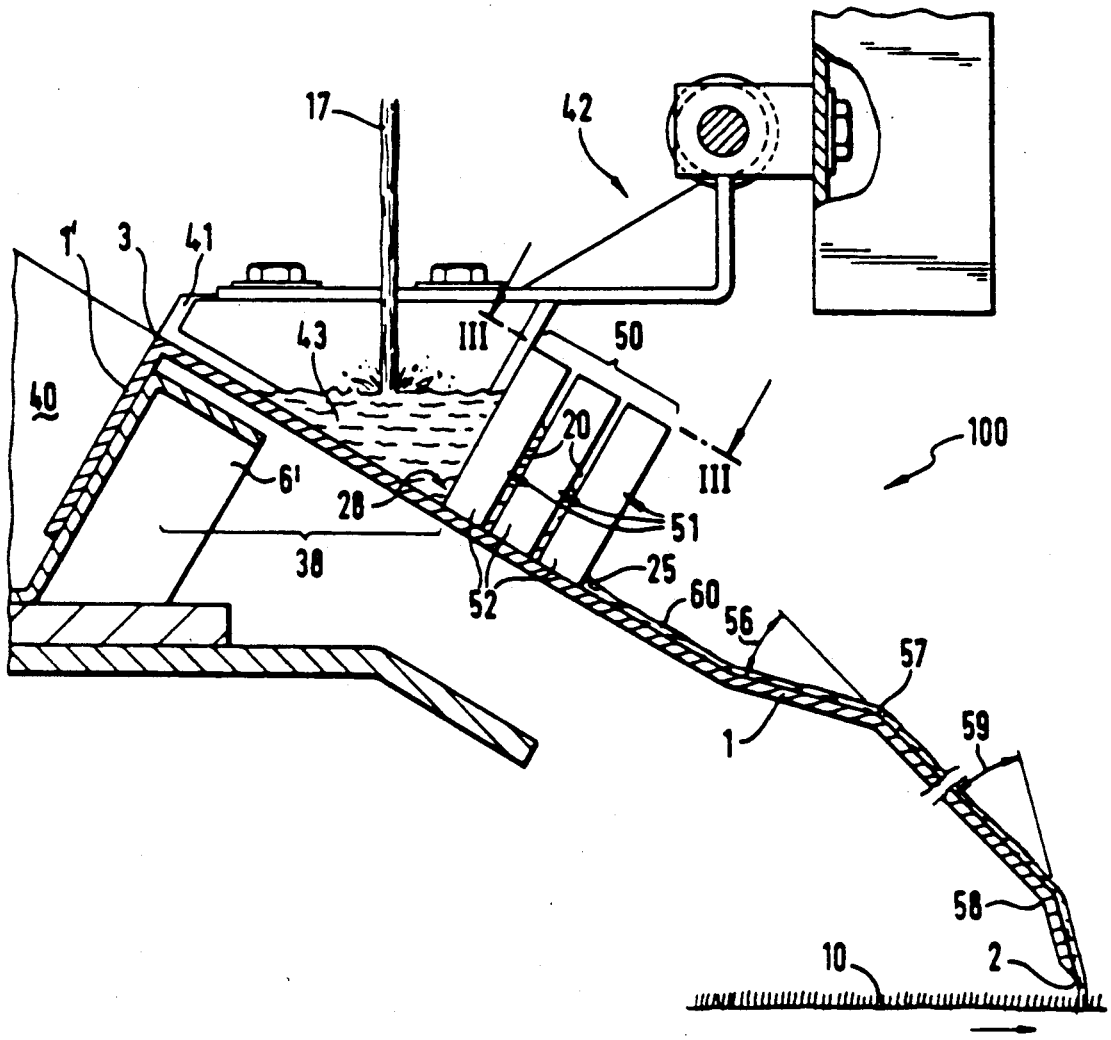
FIG. 2 is a transverse cross-sectional through view of the run-off surface of the applicator of the invention taken along a longitudinal plane perpendicular to the web.

According to FIG. 2, the shaped segments 52 are arranged in three rows 31, 32, 33 one behind the other, such that adjacent segments may be spaced in the transverse direction at a distance 15 of about 1 mm. The spacing 16 between the rows 31, 32, 33 succeeding each other in the line of fall of fluid flowing down run-off surface also is on the order of 1 mm. The aggregate of the deflection elements 51 forms a narrow rectangular field 45 that extends transversely over the run-off surface 1 at the approximate mid-height thereof.

In the illustrated embodiment, the treatment fluid is applied at the upper zone 38 of the run-off surface in the form of individual jets of fluid 17 flowing from the nozzles 8, 11 distributed over the run-off surface 1 along the transverse direction or width of the web 10. The gusset formed between the upper zone 38 of the run-off surface 1 and the top side of the topmost row of deflection elements 51 is sealed at the end regions of the two longitudinal edges of web 10 by flexible, shaped pieces 41, which are held in place by a support structure 42. The shaped pieces 41 can be displaced in the transverse direction depending on the width of the web.

The treatment fluid flowing in the form of jets 17 forms a dike 43 in front of the deflection elements 51, from where the treatment fluid enters the baffle 50 via a plurality of inlets 28. From inlets 28 the fluid flows into the channels 18 (FIG. 3) formed between the topmost row 31 of deflection elements. The height of the dike 43 depends on the quantity of treatment fluid supplied. The deflection elements 51 are sized accordingly to be high enough such that the fluid in the dike 43 will not be able to flow over the homogenizing baffle 50.

Because of the offset nature of rows 31 and 32, the treatment fluid flowing through the channels 18 in the direction of the fall line is deflected at the points 19 by 90° and then flows through the channels 20 in transverse direction. At the points 21, another deflection occurs then and the fluid flows through the channels 22 of row 32 extending in the direction of the fall line, after which still another deflection into transverse channels 23 occurs. These multiple deflections are repeated until the treatment fluid flows from the channels 24 of the bottom row 33, extending in the direction of fall, onto the run-off surface 1 via the outlets 25. The channels 18, 20, 22, 24 form a tortuous flow path for the fluid as it flows down the run-off surface.

The number of rows (31, 32, 33) of deflection elements 51 or respectively shaped segments 52 is not critical. More than three such rows can succeed one another. But fewer than two rows is not contemplated because the deflection of the quantities of fluid flowing in the direction of fall is, of course, a functionally essential factor.

It is further essential that the flow paths divided by the outlets 25 be substantially narrower than the transverse spacing of the individual fluid jets 17 applied onto the upper zone 38. In the illustrated embodiment, there are about four to five outlets 25 provided per two fluid jets. The relatively closely adjacent outlets 25 allow only relatively small quantities of fluid to flow therethrough at low speed and, after a short flow distance in the line of fall, the fluid is able to merge into a relatively uniform film flowing over the run-off surface 1. This effect is especially visible in the perspective representation of FIG. 5. In the upper zone 38 of the run-off surface 1, due to the individual fluid jets 17, which still have a certain speed throughout their length of fall, flow irregularities are created on the run-off surface 1 in the form of fluid swells 26. These swells are evened out by passage of the fluid through the homogenizing baffle 50 of the invention, so that barely any unevenness or irregularities in the fluid film are observable in the lower zone of the run-off surface. Bends 57 and 58 also contribute to this beneficial effect. Bend 57 is provided in the run-off surface below the homogenizing baffle. The bend projects upward to form an angle 56 of about 30° (degrees) and extends transversely over the width of the web 10. Downwardly directed edge bend 58 also forms an angle 59 of about 30° (degrees). The lower edge of the edge bend is sharpened in a blade-type fashion toward the fluid film 60 to form the edge 2.

Figure 4:
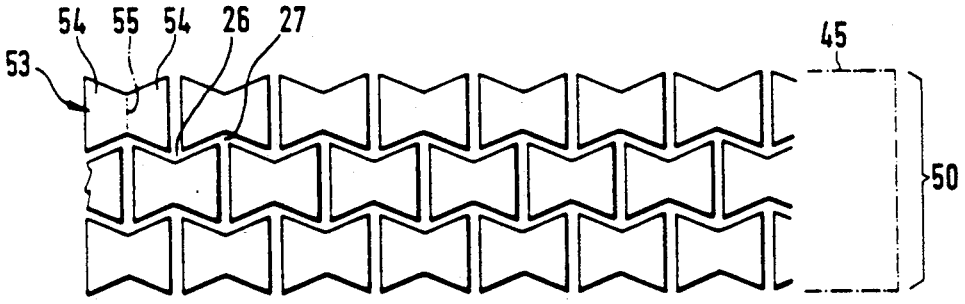
FIG. 4 is a plan view corresponding to that of FIG. 3 illustrating another embodiment of the invention.

Due to the square cross-section of the shaped segments 52 in the embodiment illustrated in FIG. 3, the repeated deflection is by about 90° (degrees) each time. In the embodiment of FIG. 4, the shaped segments 53, however, have a butterfly-shaped cross-section, i.e., a cross-section formed by two trapezoids 54 adjoined at their shorter base 55, which extends parallel to the direction of fall. The dimensions of the shaped segments 53 and the scaling of the channels remaining between the individual shaped segments 53 may essentially correspond to those of the shaped segments 51. Because the shaped segments 53 do not have a rectangular cross-section with 90° (degrees) angles, the deflections at points 26 and 27 are by more than 90° (degrees). The amount of deflection depends on the cross-sectional form of the shaped segments 53, which can be chosen as needed. In the embodiment of FIG. 4, the braking and homogenizing effect is more pronounced than in the embodiment of FIG. 3.

What is claimed is:

1. Apparatus for applying a treatment fluid onto a web of material comprising:

a support structure;

a run-off member having a top side and a bottom side, said run-off member being connected to said support structure in a position allowing a web of material to be treated in the apparatus to pass underneath the bottom side of said run-off member, said run-of member having upper and lower horizontal edges extending transverse to a web to be treated by the apparatus and defining ends of a run-off surface disposed on the top side of the run-off member, said run-off surface having an upper portion and lower portion sloping downwardly such that said lower horizontal edge is situated directly above a web to be treated by the apparatus when such a web passes underneath the run-off member;

means for supplying treatment fluid to the upper portion of the run-off surface over a width corresponding to the width of a web to be treated by the apparatus; and a flow homogenizing baffle disposed on the top side of the run-off surface between said upper and lower horizontal edges, said baffle extending over the width of the run-off surface in a transverse direction parallel to said upper and lower horizontal edges, said baffle having a uniform field of deflection elements extending outwardly from the top side of the run-off surface each of said deflection elements having an upper transverse face proximal to the upper portion of the run-off surface and a lower transverse face proximal to the lower portion of the run-off surface, the deflection elements being arranged in at least three rows of deflection elements, the deflection elements within each of the rows being spaced from each other by a first small distance to define therebetween longitudinal channels generally perpendicular to the transverse direction, each of the longitudinal channels having an end proximal to the lower portion of the run-off surface, the rows being spaced from each other by a second small distance in the transverse direction to define therebetween transverse channels, the transverse channels being in communication with the longitudinal channels, each row being mutually offset in the transverse direction relative to each other such that the longitudinal channels intersect the transverse channels opposite the transverse faces, the distal ends of the longitudinal channels intersecting the transverse channels such that the angle therebetween is 90° or less whereby treatment fluid flowing down the upper portion of the run-off surface enters the baffle through the longitudinal channels in the row of deflection elements closest to the upper portion of the run-off surface, is deflected several times in the longitudinal and transverse channels, thereby creating turbulence and reducing the velocity of the treatment fluid, exits the baffle through the longitudinal channels in the row of deflection elements closest to the lower portion of the run-off surface, and flows over the lower horizontal edge of the run-off surface in a veil uniform across the width of the run-off surface.

2. Apparatus according to claim 1, wherein said deflection elements have a butterfly-shaped cross-section in a plane generally parallel to the run-off surface formed by two equal trapezoids adjoined at their short bases, and said short bases extend in a direction perpendicular to the transverse direction.

3. Apparatus according to claim 1, wherein said deflecting elements have a rectangular cross-section in a plane generally parallel to said run-off surface, said upper and lower transverse faces of said elements being parallel.

4. Apparatus according to claim 3, wherein said deflecting elements have a square cross-section.

* * * * *